US009233456B2

(12) United States Patent
Chang

(10) Patent No.: US 9,233,456 B2
(45) Date of Patent: Jan. 12, 2016

(54) SELECTIVELY ONE-WAY WRENCH

(71) Applicant: Hui-Ling Chang, Taichung (TW)

(72) Inventor: Hui-Ling Chang, Taichung (TW)

( * ) Notice: Subject to any disclaimer, the term of this patent is extended or adjusted under 35 U.S.C. 154(b) by 267 days.

(21) Appl. No.: 14/019,190

(22) Filed: Sep. 5, 2013

(65) Prior Publication Data

US 2015/0059532 A1 Mar. 5, 2015

(51) Int. Cl.
*B25B 13/46* (2006.01)
*B25B 13/04* (2006.01)

(52) U.S. Cl.
CPC ..... *B25B 13/463* (2013.01); *B25B 13/04* (2013.01)

(58) Field of Classification Search
CPC ..... B25B 13/04; B25B 13/06; B25B 13/46; B25B 13/463
USPC ..... 81/63.1, 62
See application file for complete search history.

(56) References Cited

U.S. PATENT DOCUMENTS

| | | | | |
|---|---|---|---|---|
| 8,683,894 | B1 * | 4/2014 | Chen et al. | 81/63.1 |
| 2009/0314139 | A1 * | 12/2009 | Hu | 81/63.1 |
| 2010/0018357 | A1 * | 1/2010 | Hu | 81/63.1 |
| 2013/0152742 | A1 * | 6/2013 | Chen | 81/63.1 |
| 2014/0311300 | A1 * | 10/2014 | Chen | 81/63.1 |

* cited by examiner

*Primary Examiner* — Hadi Shakeri

(57) ABSTRACT

A selectively one-way wrench includes a handle, a socket, a pawl and a switch. The handle includes a grip, a head in a plane other than that of the grip, a transient portion extending to the head from the grip, and a recess in the head near the transient portion. The socket includes a series of teeth placed in the head. The pawl includes two pawls placed in the head and a spring for interconnecting the pawls. Each of the pawls includes teeth for engagement with the teeth of the socket. The switch includes a sliding unit movable between two positions for engagement with the pawls and a finger-contacting element extending from the sliding unit. The finger-contacting element is placed in the recess except an upper end placed above the grip.

8 Claims, 7 Drawing Sheets

SELECTIVELY ONE-WAY WRENCH

BACKGROUND OF INVENTION

1. Field of Invention

The present invention relates to a wrench and, more particularly, to a selectively one-way wrench.

2. Related Prior Art

A selectively one-way wrench with a reduced head is disclosed in US Patent Application Publication No. 20120180603. The selectively one-way wrench includes a body 20 that includes a connecting portion 22 between a handle 23 and a head 21. The connecting portion 22 includes, near the head 21, an arched concave face 222 for containing a switch 50 operable to control a drive member 30 placed in the head 21. Thus, the selectively one-way wrench can be used to rotate a screw or nut in a selected direction without rotating the screw or nut in an opposite direction. The switch 50 is in the form of a ring, not a lever. Hence, it requires two fingers to pinch and rotate the switch 50, and this is troublesome.

Therefore, the present invention is intended to obviate or at least alleviate the problems encountered in prior art.

SUMMARY OF INVENTION

It is the primary objective of the present invention to provide a selectively one-way wrench easily operable between two driving modes.

To achieve the foregoing objective, the selectively one-way wrench includes a handle, a socket, a pawl and a switch. The handle includes a grip, a head in a plane other than that of the grip, a transient portion extending to the head from the grip, and a recess in the head near the transient portion. The socket includes a series of teeth placed in the head. The pawl includes two pawls placed in the head and a spring for interconnecting the pawls. Each of the pawls includes teeth for engagement with the teeth of the socket. The switch includes a sliding unit movable between two positions for engagement with the pawls and a finger-contacting element extending from the sliding unit. The finger-contacting element is placed in the recess except an upper end placed above the grip.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
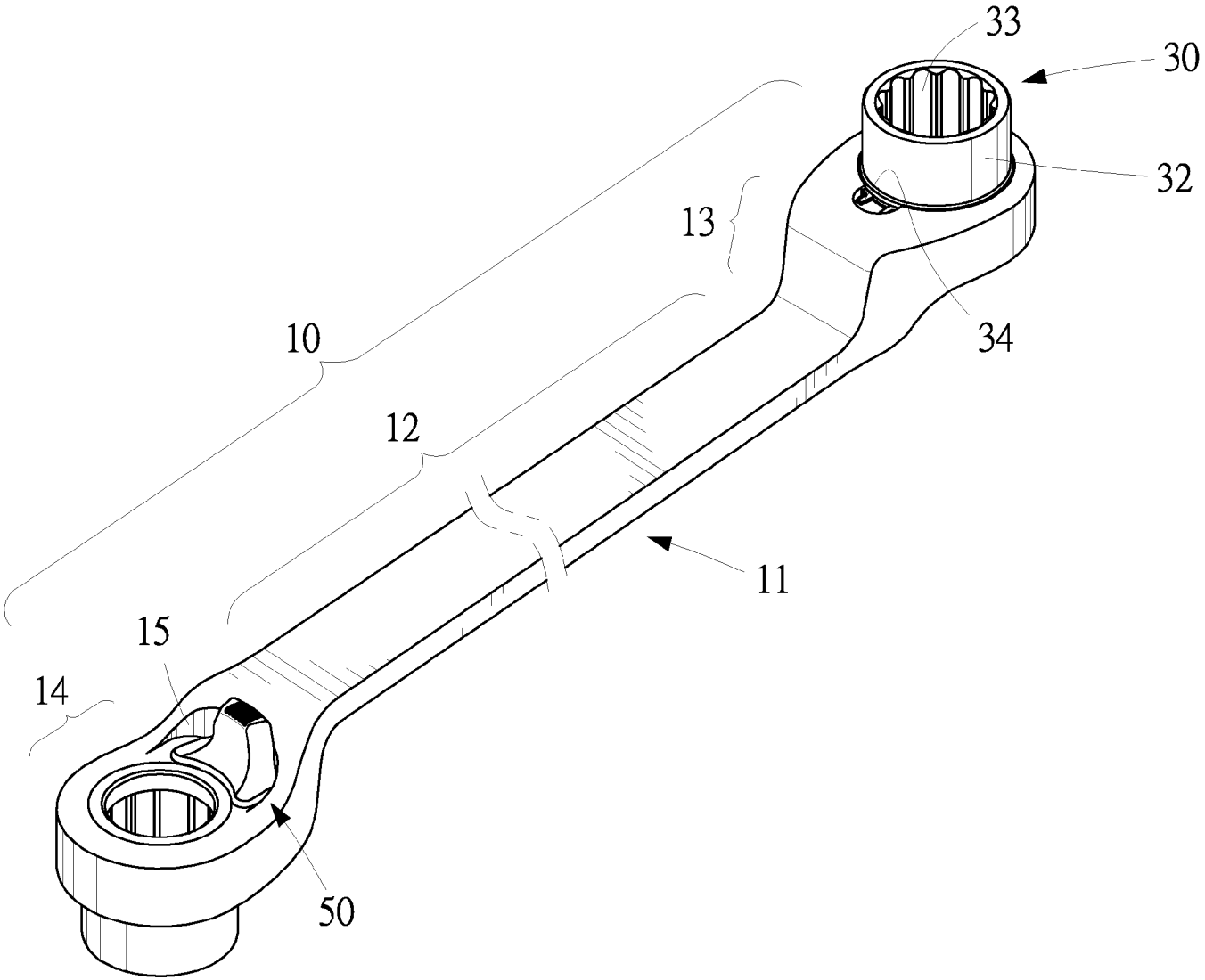
FIG. 1 is a perspective view of a selectively one-way wrench according to the preferred embodiment of the present invention.
Figure 2:
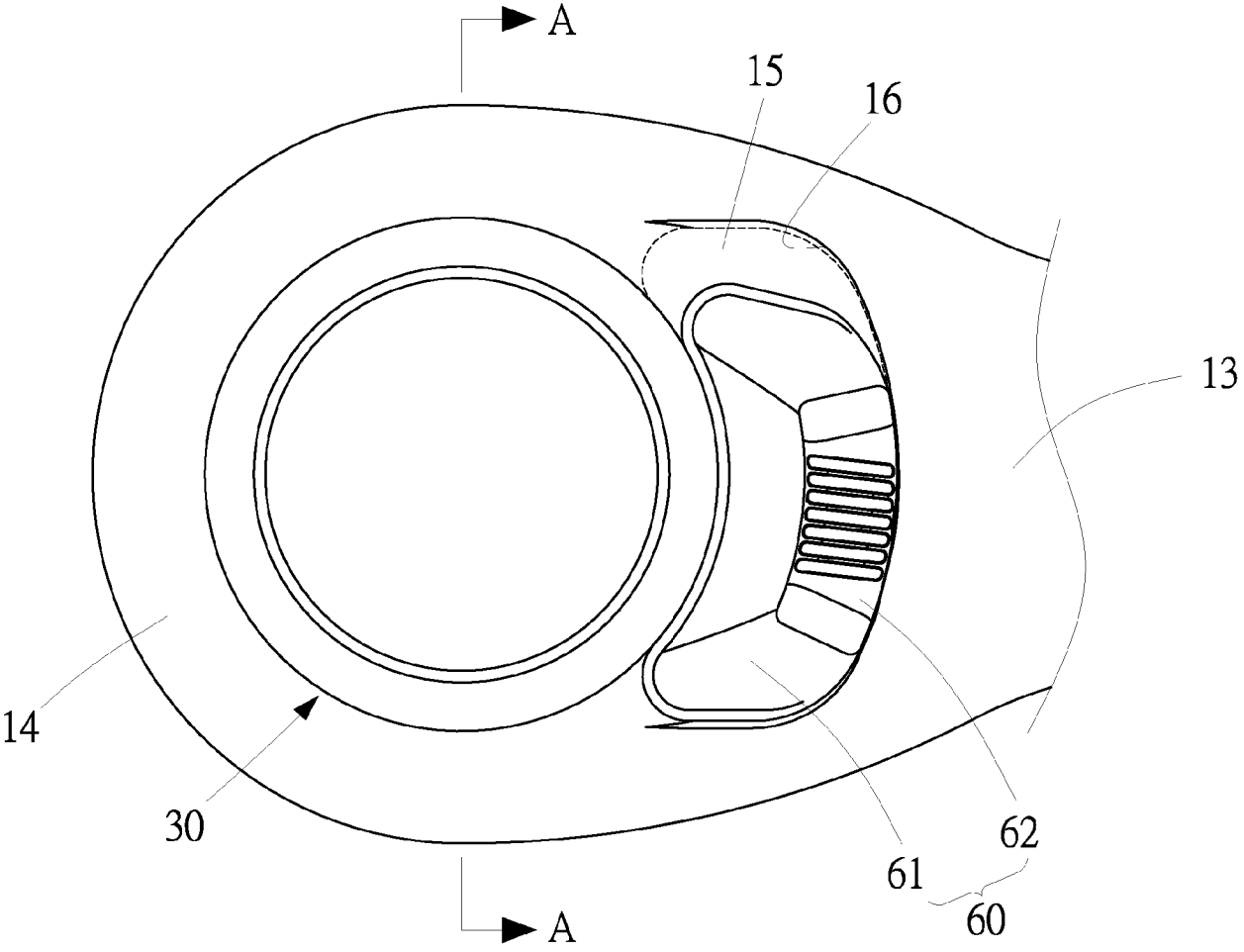
FIG. 2 is a partial, top view of the selectively one-way wrench shown in FIG. 1.
Figure 3:
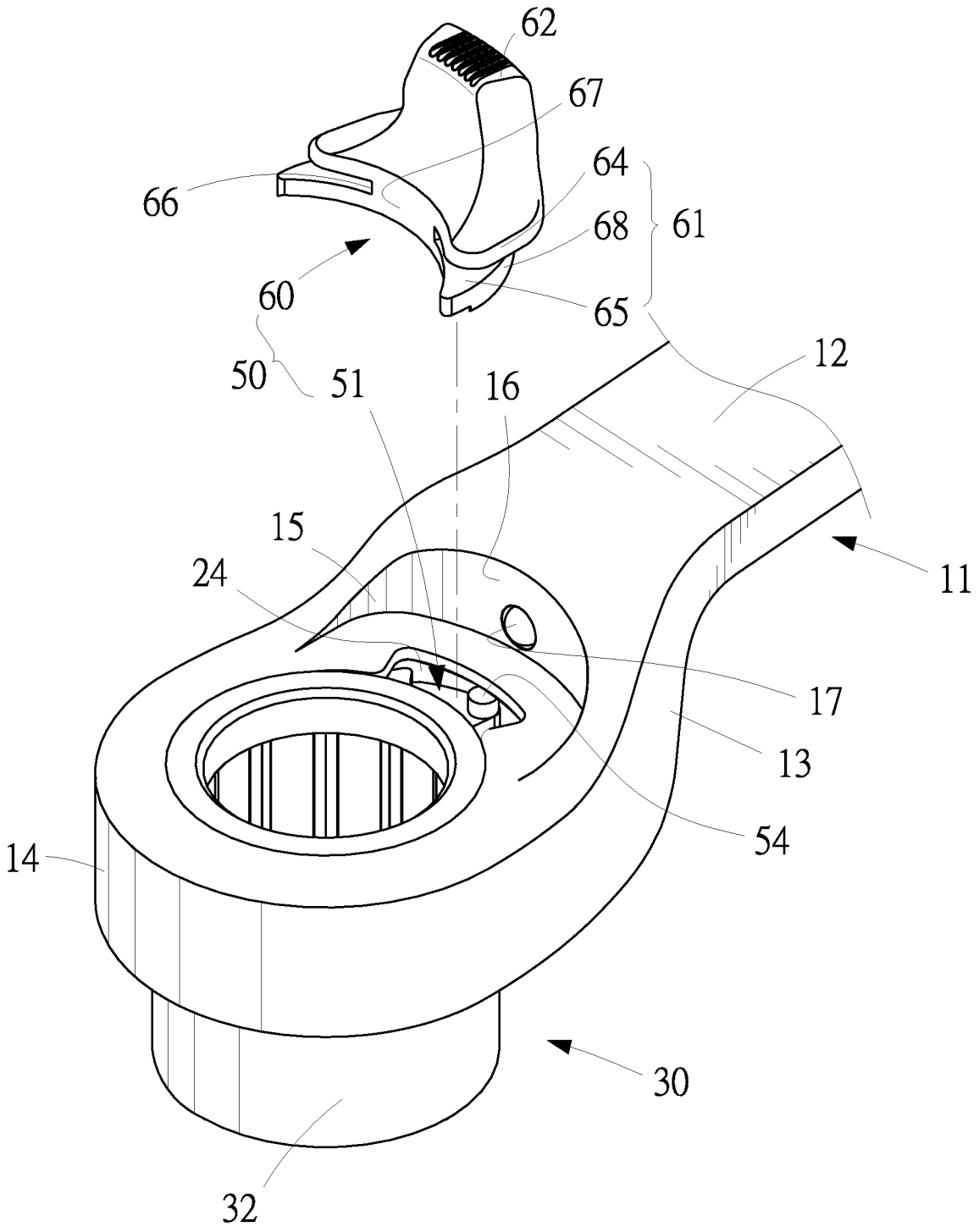
FIG. 3 is a partial, exploded view of the selectively one-way wrench shown in FIG. 1.

Referring to FIGS. 1 to 3, there is a selectively one-way wrench 10 according to the preferred embodiment of the present invention. The selectively one-way wrench 10 includes a handle 11, two sockets 30, two selectively one-way drivers 50 and two switches 60. The handle 11 includes a grip 12 extending between two heads 14. A transient portion 13 is formed between each head 14 and the grip 12. Each transient portion 13 is S-shaped in a side view. Each transient portion 13 includes a recess 15. A switch-positioning unit 17 is placed in a bore made in a wall of the recess 15. The switch-positioning unit 17 is a ball biased by a spring (not shown) placed in the bore.

Figure 4:
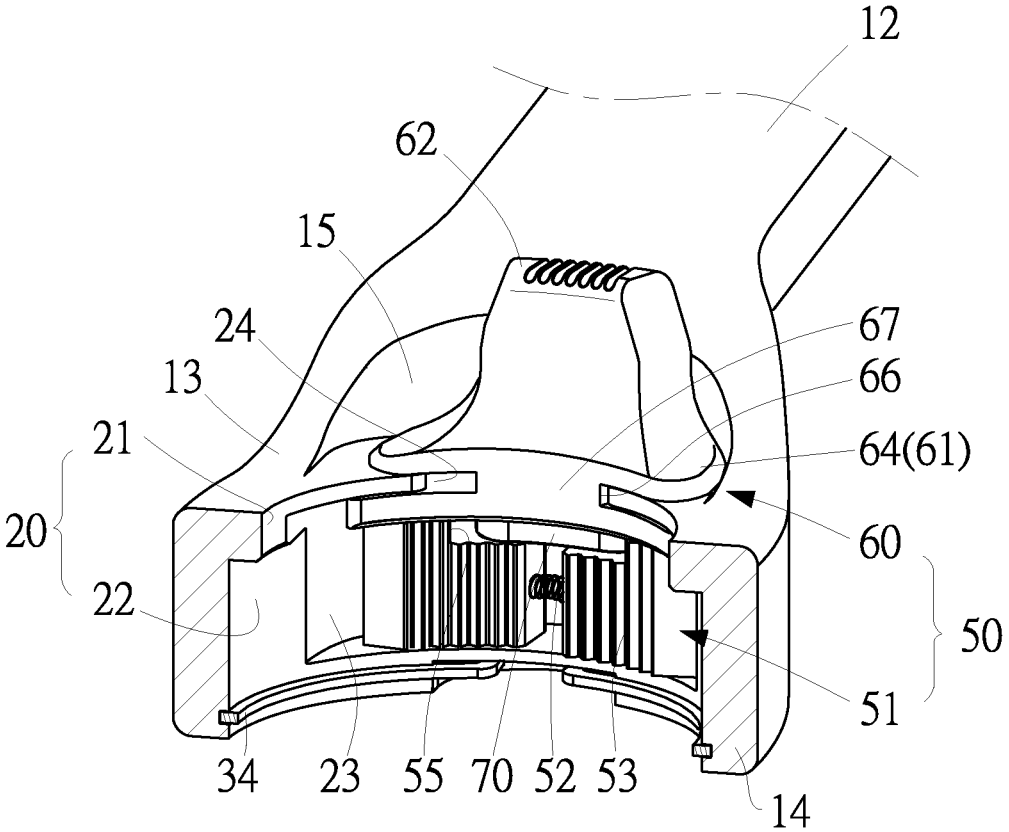
FIG. 4 is a partial, cut-away view of the selectively one-way wrench shown in FIG. 1.

Referring to FIG. 4, the heads 14 are hollow. Each head 14 includes openings 21, 22 and 24 and a cavity 23. The openings 21 and 22 are coaxial circular openings in communication with each other. The diameter of the opening 21 is smaller than that of the opening 22. The opening 24 is a crescent opening next to and in communication with the opening 21. The cavity 23 is a crescent cavity next to and in communication with the opening 22. The cavity 23 is in communication with the opening 24.

Figure 5:
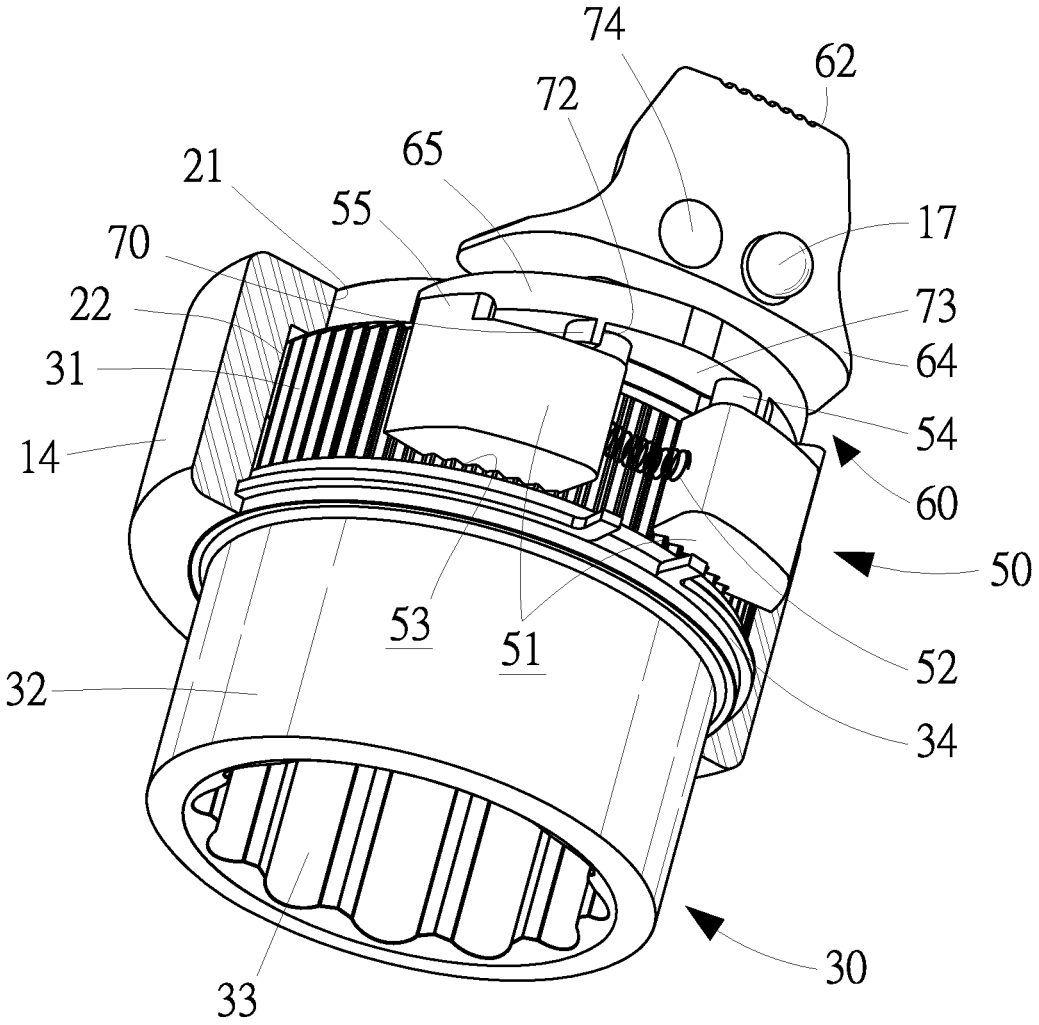
FIG. 5 is another partial, cut-away view of the selectively one-way wrench shown in FIG. 1.

Referring to FIG. 5, each socket 30 includes an upper portion, a lower portion, and teeth 31 formed on an external side between the upper and lower portions. The teeth 31 together form an annular rack.

Each selectively one-way driver unit 50 includes two pawls 51 interconnected by a spring 52. Each pawl 51 is formed with teeth 53 corresponding to the teeth 31. Each pawl 51 further includes two blocks 54 and 55 formed on an upper face. The blocks 54 and 55 are made of a substantially same height.

Figure 6:
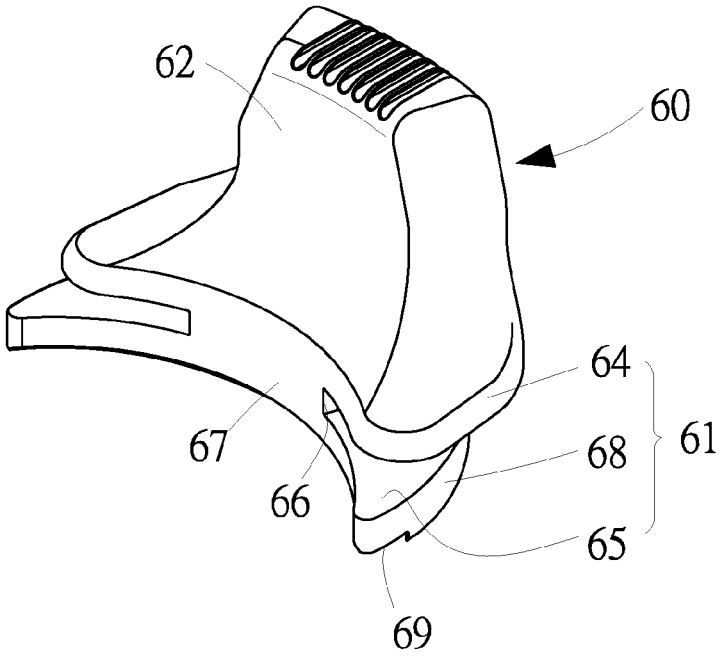
FIG. 6 is a perspective view of a switch of the selectively one-way wrench shown in FIG. 1.
Figure 7:
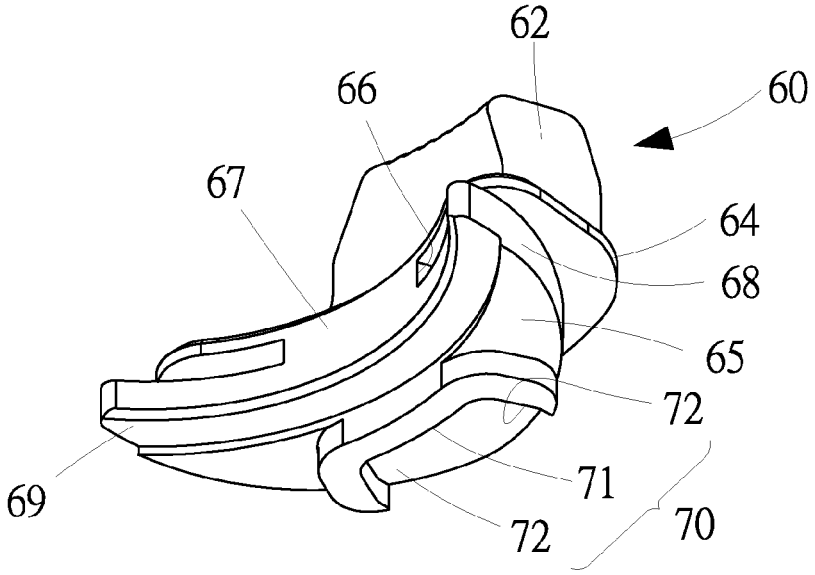
FIG. 7 is another perspective view of the switch shown in FIG. 6.
Figure 8:
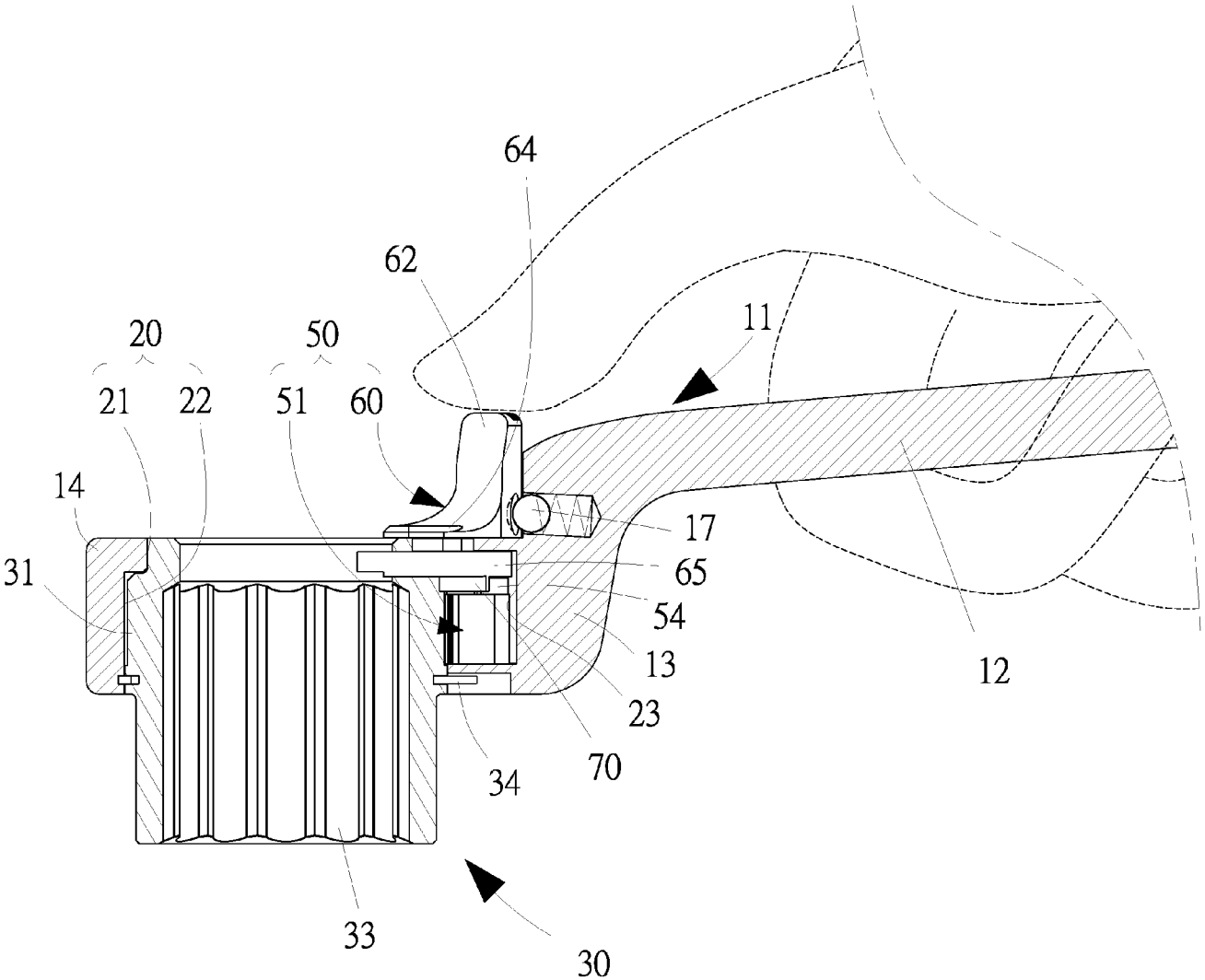
FIG. 8 is a partial, cross-sectional view of the selectively one-way wrench shown in FIG. 1.

Referring to FIGS. 5 to 7, each switch 60 includes a finger-contacting element 62 formed on a sliding unit 61. The sliding unit 61 includes two plates 64 and 65 interconnected by a waist 66. The sliding unit 61 further includes an arched concave face 67, an arched convex face 68 opposite to the arched concave face 67, an arched groove 69 made in a lower face and along the arched concave face 67, and a rib 70 extending on the lower face in a substantially U-shaped path and including a middle portion 71 and two terminal portions 72.

Referring to FIG. 5, the finger-contacting element 62 is in the form of an upright tab formed with an anti-skid upper end for firm contact with a finger such as a thumb. The finger-contacting element 62 includes two recesses 74 made in an arched convex face corresponding to the arched convex face of the arched convex face 68.

The assembly of the selectively one-way wrench 10 will be described below. For the convenience of the description, the description will be done on only one of the sockets 30, the corresponding one of the heads 14 the corresponding one of the selectively one-way drivers 50, and the corresponding one of the switches 60.

The selectively one-way driver 50 is placed in the cavity 23 of the head 14. The finger-contacting element 62 of the switch 60 except the anti-skid upper end is placed in the recess 15. The anti-skid upper end of finger-contacting element 62 is placed above the grip 12. The waist 66 of the switch 60 is placed in the opening 24 of the head 14. An arched portion of the head 14 along the opening 24 is placed between the plates 64 and 65 of the switch 60. The blocks 54 of the pawls 51 are placed between the terminal portions 72 of the rib 70 of the switch 60. The switch-positioning unit 17 can be placed in a selected one of the recesses 74.

The upper portion of the socket 30 is placed in the opening 21 of the head 14. The upper portion of the socket 30 is in contact with the arched concave face 67. The lower portion 32 of the socket 30 is inserted through the opening 22 of the head 14 before a C-clip 34 is placed around the lower portion 32 of the socket 30 and in a groove made in the wall of opening 22 of the head 14. Thus, the rack, which consists of the teeth 31, is restrained between the C-clip 34 and an annular portion of the head 14 around the opening 21. An upper portion of the rack is placed movably in the arched groove 69. The teeth 31 can be engaged with the teeth 53 of a selected one of the pawls 51.

The switch 60 is movable between two positions. As the switch 60 is in one of the positions, the switch-positioning unit 17 is placed in the first recess 74. One of the terminal portions 72 of the rib 70 pushes the block 54 of one of the pawls 51 so that the teeth 53 of the other pawl 51 are engaged with the teeth 31 of the socket 30. Thus, the selectively one-way wrench 10 can be used to rotate a screw or nut that is partially placed in the socket 30 in a selected one of two opposite directions without rotating the screw or nut in the other direction.

Advantageously, the switch 60 is operable by the thumb of a hand holding the grip 12. Therefore, it requires a single hand to operate the selectively one-way wrench 10 including the rotation of the screw or nut and the movement of the switch 60.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A selectively one-way wrench including:

a handle including a grip, a head in a plane other than that of the grip and formed with a first circular opening, a second circular opening, a crescent cavity and a crescent opening, a transient portion extending to the head from the grip, and a recess in the head near the transient portion;

a socket including an upper portion inserted in the first circular opening, a lower portion, and a series of teeth formed between the upper and lower portions and placed in the second circular opening of the head;

a selectively one-way driver including two pawls placed in the crescent cavity of the head and a spring for interconnecting the pawls, wherein each of the pawls includes teeth for engagement with the teeth of the socket; and a switch including a sliding unit movable between two positions for engagement with the pawls and a finger-contacting element extending from the sliding unit, wherein the sliding unit includes two plates and a waist formed between the plates, wherein an arched portion of the head along the crescent opening is placed between the plates of the sliding unit, wherein the finger-contacting element is placed in the recess except an upper end placed above the grip.

2. The selectively one-way wrench according to claim 1, including a switch-positioning unit connected to the head, wherein the finger-contacting element of the switch includes two recesses, wherein the switch positioning unit can be inserted in a selected one of the recesses to keep the switch in a corresponding one of the positions.

3. The selectively one-way wrench according to claim 2, wherein the switch-positioning unit is a spring-biased ball.

4. The selectively one-way wrench according to claim 1, wherein the sliding unit includes a rib on a lower face, each of the pawls includes a block thereon, wherein the rib is in contact with the block of a selected one of the pawls as the switch is in a corresponding one of the positions.

5. The selectively one-way wrench according to claim 4, wherein the rib includes two terminal portions and a middle portion between the terminal portions, wherein a selected one of the terminal portions of the rib is in contact with the block of a corresponding one of the pawls as the switch is in a corresponding one of the positions.

6. The selectively one-way wrench according to claim 5, wherein the blocks of the pawls are placed between the terminal portions of the rib.

7. The selectively one-way wrench according to claim 1, including a C-clip attached to a wall of the lower circular opening, placed around the lower portion of the socket, and abutted against the series of teeth of the socket.

8. The selectively one-way wrench according to claim 1, wherein the sliding unit includes an arched concave face for contact with the periphery of the upper portion of the socket.

* * * * *